US005739494A

United States Patent [19]

Frost

[11] Patent Number: 5,739,494

[45] Date of Patent: Apr. 14, 1998

[54] SWITCH ACTUATOR WITH MULTIPLE CONTROLS AND A SINGLE SWITCH

[75] Inventor: Richard L. Frost, Freeport, Ill.

[73] Assignee: Honeywell Inc., Minneapolis, Minn.

[21] Appl. No.: 625,979

[22] Filed: Apr. 1, 1996

[51] Int. Cl.[6] ..... H01H 9/06

[52] U.S. Cl. ..... 200/61.86; 431/255

[58] Field of Search ..... 200/4, 5 R, 5 B, 200/5 C, 11 R, 16 R, 17 R, 18, 1 R, 52 R, 518, 573, 574, 50.32, 50.33, 61.85, 61.86, 329, 336, 337, 50.07, 50.34, 50.35, 50.37, 50.4, 568, 572; 219/260, 262, 267, 268, 269, 270, 391, 395, 397, 398, 414, 483, 486, 507, 508; 431/127, 128, 132, 254, 255, 256, 257; 126/39 E, 39 R

[56] References Cited

U.S. PATENT DOCUMENTS

| | | | |
|---|---|---|---|
| 2,101,430 | 12/1937 | Goldbert et al. | 200/50 |
| 2,328,801 | 9/1943 | Hammell | 200/50 |
| 2,593,288 | 4/1952 | Fisher | 200/50 |
| 3,768,959 | 10/1973 | Rohde et al. | 431/255 |
| 4,003,360 | 1/1977 | Branson | 126/39 E |
| 4,019,855 | 4/1977 | Camillo | 431/256 |
| 5,545,034 | 8/1996 | De Gouville | 431/255 |

*Primary Examiner*—Michael L. Gellner
*Assistant Examiner*—Michael A. Friedhofer
*Attorney, Agent, or Firm*—William D. Lanyi; John G. Shudy, Jr.

[57] ABSTRACT

A switch actuator is provided in which any one of a plurality of rotatable cams is capable of actuating a single switch simultaneously with controlling another mechanism, such as a gas valve that is associated with that particular rotatable cam. When used in conjunction with a kitchen range, each of the rotatable cams controls an associated gas valve which, in turn, controls the flow of natural gas to an associated burner. Each of the rotatable cams is disposed within an associated one of a plurality of openings formed through the thickness of a movable member. The movable member is attached in sliding relation with a stationary member which, in turn, can be attached to a stationary device such as a kitchen range. Each of the openings formed through the thickness of the movable member is provided with an edge that is shaped to perform the function of a cam follower. This cam following edge is disposed in contact with a cam surface attached to the rotatable cam. When the rotatable cam rotates about its central axis, the cam surface moves into contact with portions of the cam following edge of the opening and causes the movable member to move relative to the stationary member and actuate a switch which provides electrical current to a plurality of igniters.

16 Claims, 12 Drawing Sheets

SWITCH ACTUATOR WITH MULTIPLE CONTROLS AND A SINGLE SWITCH

BACKGROUND OF THE INVENTION

1. Field of the Invention

The present invention relates generally to a switch actuator and, more particularly, a switch actuator which comprises a plurality of individual controls which are capable of controlling a single switch without interfering with each other.

2. Description of the Prior Art

In many applications, it is desirable to have a switch control mechanism in which a single switch can be actuated by a plurality of individual control mechanisms. For example, in the control of a kitchen range, it is desirable to have a plurality of control mechanisms, such as rotatable dials, which can each control a single switch that activates an igniter. In applications of this type, each of the control mechanisms is typically connected to an individual gas valve that provides a flow of a flammable gas, such as natural gas, propane, butane, LPG or other types of fuel gas, to an individual burner. When any one of the control mechanisms is actuated, the single switch provides electrical current to a single igniter or a group of igniters and natural gas is provided to a specific one of a plurality of burners. The igniter associated with the selected burner causes the flow of gas to be ignited for that burner.

In most applications of the type described immediately above, each of the actuating mechanisms is associated with an individual switch and is individually constructed to be independent from the other control mechanisms of the kitchen range. This type of construction involves manufacturing procedures and associated expenses that could be eliminated if an improved switch actuator could be provided that requires only a single switch and which permits any one of the actuating mechanisms to activate the switch while providing a flow of gas to its associated burner.

SUMMARY OF THE INVENTION

A switch actuator made in accordance with the present invention comprises a stationary member and a movable member which are attached is slideable relation with each other. It further comprises a plurality of openings formed through the movable member. Each of the plurality of openings has an edge that is shaped to serve as a cam follower. A plurality of holes is formed through the stationary member with each of the plurality of holes being aligned with an associated one of the plurality of openings.

A plurality of rotatable cams is provided, wherein each of the rotatable cams is disposed within an associated one of the openings and is disposed proximate the cam follower edge of the associated opening. Each of the rotatable cams is rotatable about an associated one of a plurality of central axes. Each one of the plurality of central axes extends through an associated one of the plurality of holes in the stationary member. With an arrangement of this type, rotation of any one of the plurality of rotatable cams will cause the associated cam follower edge of the associated opening to move relative to the central axis of the associated rotatable cam and cause the movable member to move relative to the stationary member.

The present invention further comprises a switch actuating protrusion that is attached to the movable member. Furthermore, the present invention comprises a switch that is attached to the stationary member. The switch comprises a plunger whereby movement of the movable member relative to the stationary member in a preselected direction moves the switch actuating protrusion against the plunger and actuates the switch.

In a particularly preferred embodiment of the present invention, it further comprises a plurality of gas valves wherein each of the gas valves is connected to an associated one of the plurality of rotatable cams and is actuated in response to rotation of the associated rotatable cam. A plurality of burners can further be provided in which each of the plurality of burners is connected in fluid communication with an associated one of the plurality of gas valves.

In a particularly preferred embodiment of the present invention, it further comprises a plurality of igniters wherein each of the plurality of igniters is disposed in gas igniting relation with an associated one of the burners. Each of the plurality of igniters is electrically connected to the switch. The plurality of burners can be attached to a kitchen range.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
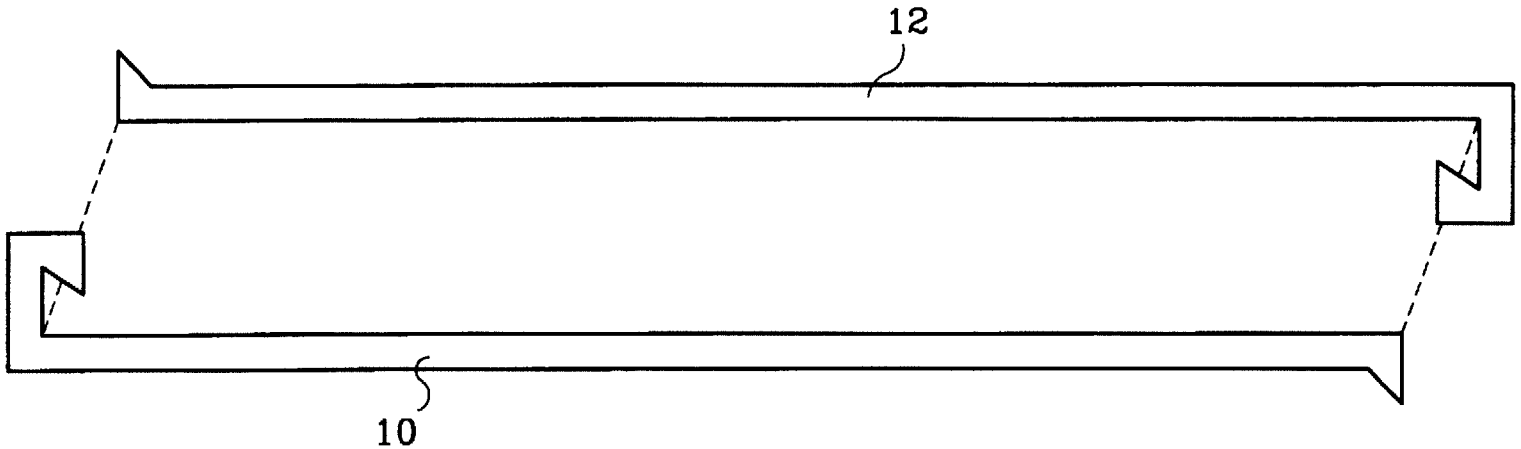
FIG. 1 shows the stationary and movable members in an edge representation.

Throughout the Description of the Preferred Embodiment, like components will be identified by like reference numerals. In FIG. 1, a stationary member 10 is shown in edge view and in relation to a movable member 12. The edge views of the stationary and movable members illustrate the configuration of the cross sectional areas of both members. The dashed lines in FIG. 1 show the positions of the two members that are associated together to lock them into sliding relation with each other.

Figure 2:
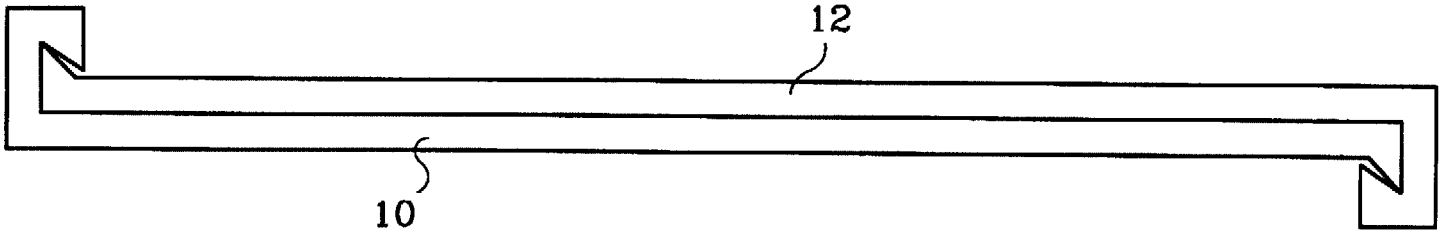
FIG. 2 shows the stationary and movable members attached together in sliding relation with each other.

FIG. 2 shows the stationary member 10 and the movable member 12 locked together so that they may slide relative to each other. In a preferred embodiment of the present invention, the stationary member 10 is typically attached in rigid association with a stationary structure, such as a kitchen range. The movable member 12 is able to slide relative to the stationary member 10 along a direction that is perpendicular to the illustration of FIG. 2.

Figure 3:
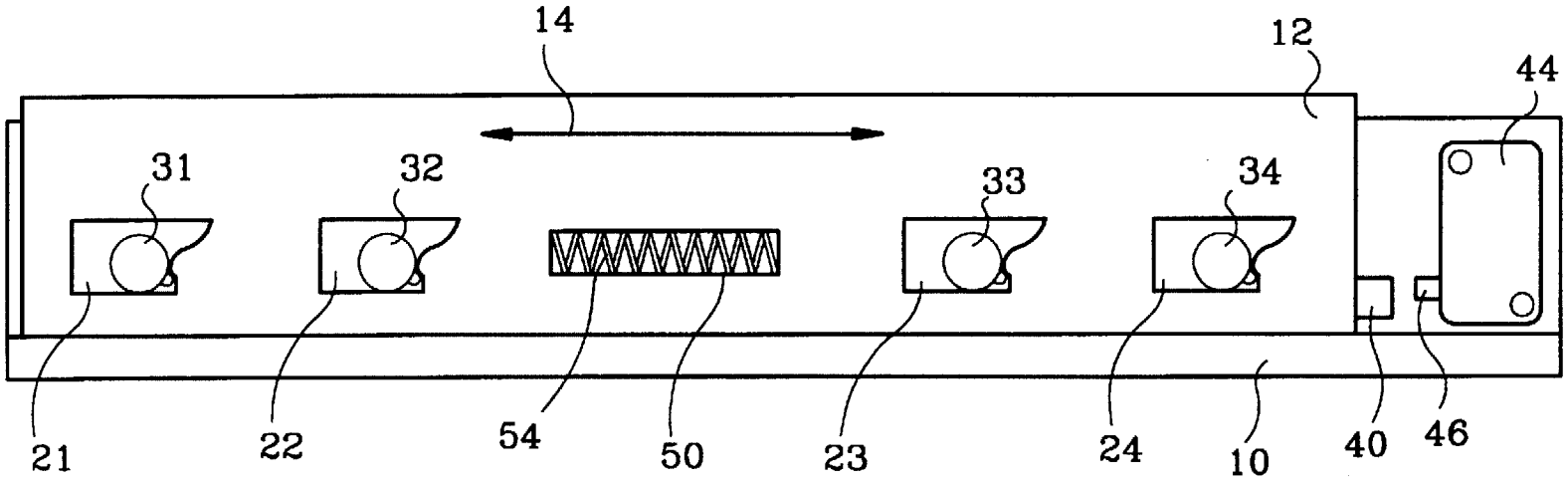
FIG. 3 shows the stationary and movable members in a side view to illustrate the openings and rotatable cams of the present invention.

In FIG. 3, the stationary member 10 and the movable member 12 are shown attached to each other. The movable member 12 is movable along an axis indicated by arrow 14. The movable member 12 is provided with a plurality of openings, 21–24, that are formed through the thickness of the movable member. A plurality of rotatable cams, 31–34, are disposed within the openings, 21–24, of the movable member 12. As will be described in greater detail below, the rotatable cams extend through holes formed through the thickness of the stationary member 10. A switch actuation protrusion 40 is formed as part of the movable member 12.

As shown in FIG. 3, a switch 44 is rigidly attached to the stationary member 10. The switch 44 comprises a plunger 46. When the movable member 12 moves toward the right in FIG. 3 relative to the stationary member 10, the switch actuating protrusion 40 moves into contact with the plunger 46 and actuates the switch 44. A space 50 is provided through both the stationary member 10 and the movable member 12 in a preferred embodiment of the present invention in order to provide a place where the spring 54 can be disposed. The purpose of the spring 54 is to return the movable member 12 to an initial position when none of the rotatable cams, 31–34, is rotated from its rest position. As will be described in greater detail below, each of the openings, 21–24, is provided with an edge that serves as a cam follower surface. In FIG. 3, the cam follower surfaces are located at the right sides of the plurality of openings, 21–24. If any one of the rotatable cams, 31–34, is rotated about its central axis, the movable member 12 moves toward the right and causes the switch actuating protrusion 40 to move against the plunger and actuate the switch. This rotation of one of the rotatable cams does not affect the other ones of the plurality of rotatable cams. As can be seen in FIG. 3, each of the openings, 21–24, is provided with space to the left of the rotatable cam to allow the movable member 12 to move toward the right without affecting the other rotatable cams which are not rotated about their central axes.

Figure 4:
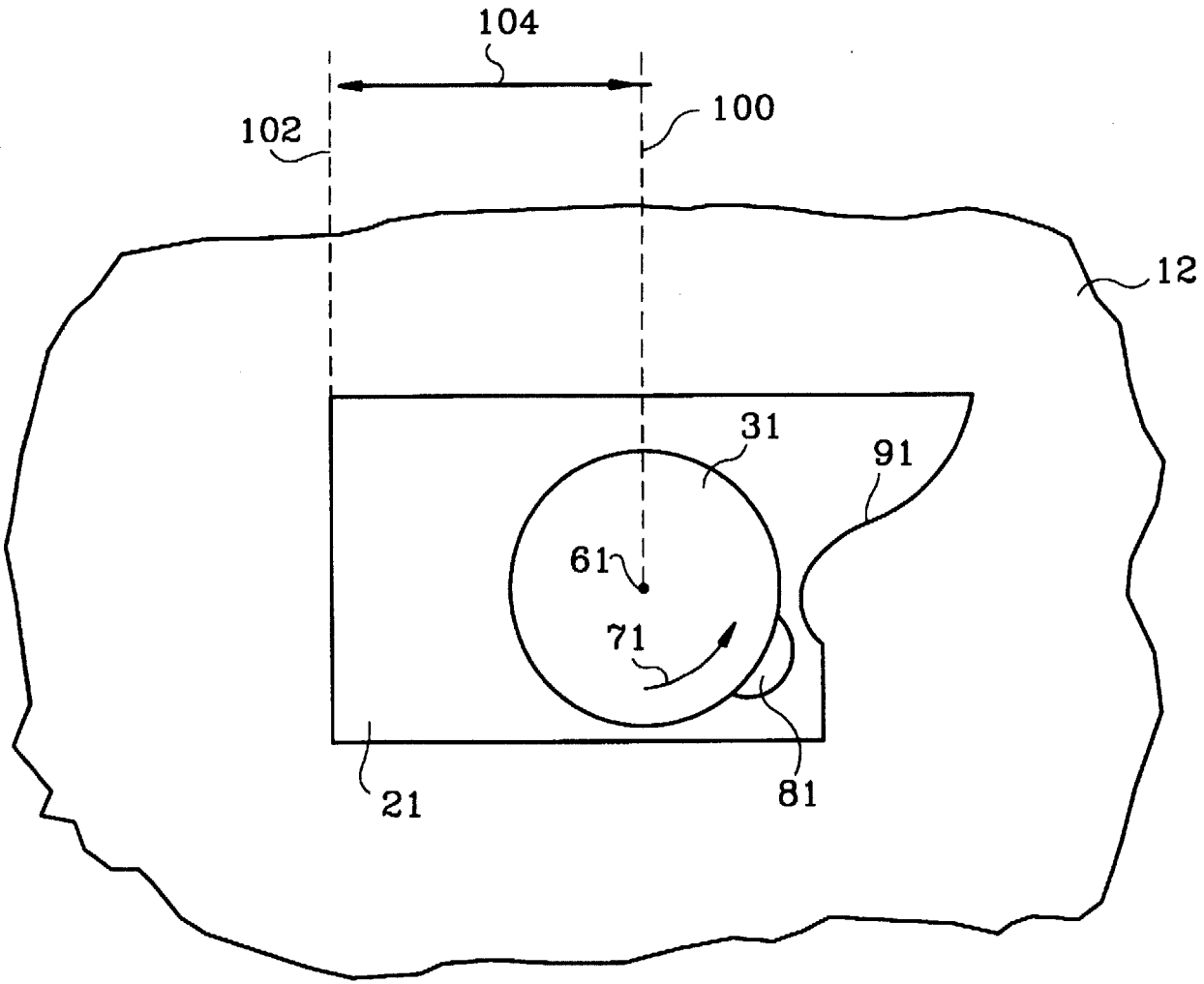
FIG. 4 shows one of the openings with its associated rotatable cam.

FIG. 4 is an enlarged view of one of the openings 21 and its associated rotatable cam 31 which is disposed within it. The rotatable cam 31 is rotatable about its central axis 61 in a direction represented by arrow 71. The opening 21 has an edge 91 that is shaped to serve as a cam follower. The rotatable cam 31 has a cam surface 81 that is movable against the cam follower edge 91. For purposes of demonstrating the action of the mechanism shown in FIG. 4, two dashed lines are provided for illustrative purposes. One dashed line 100 represents the position of the central axis 61 about which the rotatable cam 31 can rotate. Since the central axis of the rotatable cams are located in a fixed position relative to a stationary device, such as a kitchen range, it will not move in response to rotation of the rotatable cam 31. Another dashed line 102 represents the left edge of opening 21. The left edge of the opening has been chosen as a representative reference to illustrate the movement of the opening 21 and the movable member 12 through which it is formed. Arrow 104 shows the distance between dashed lines 100 and 102.

Figure 5:
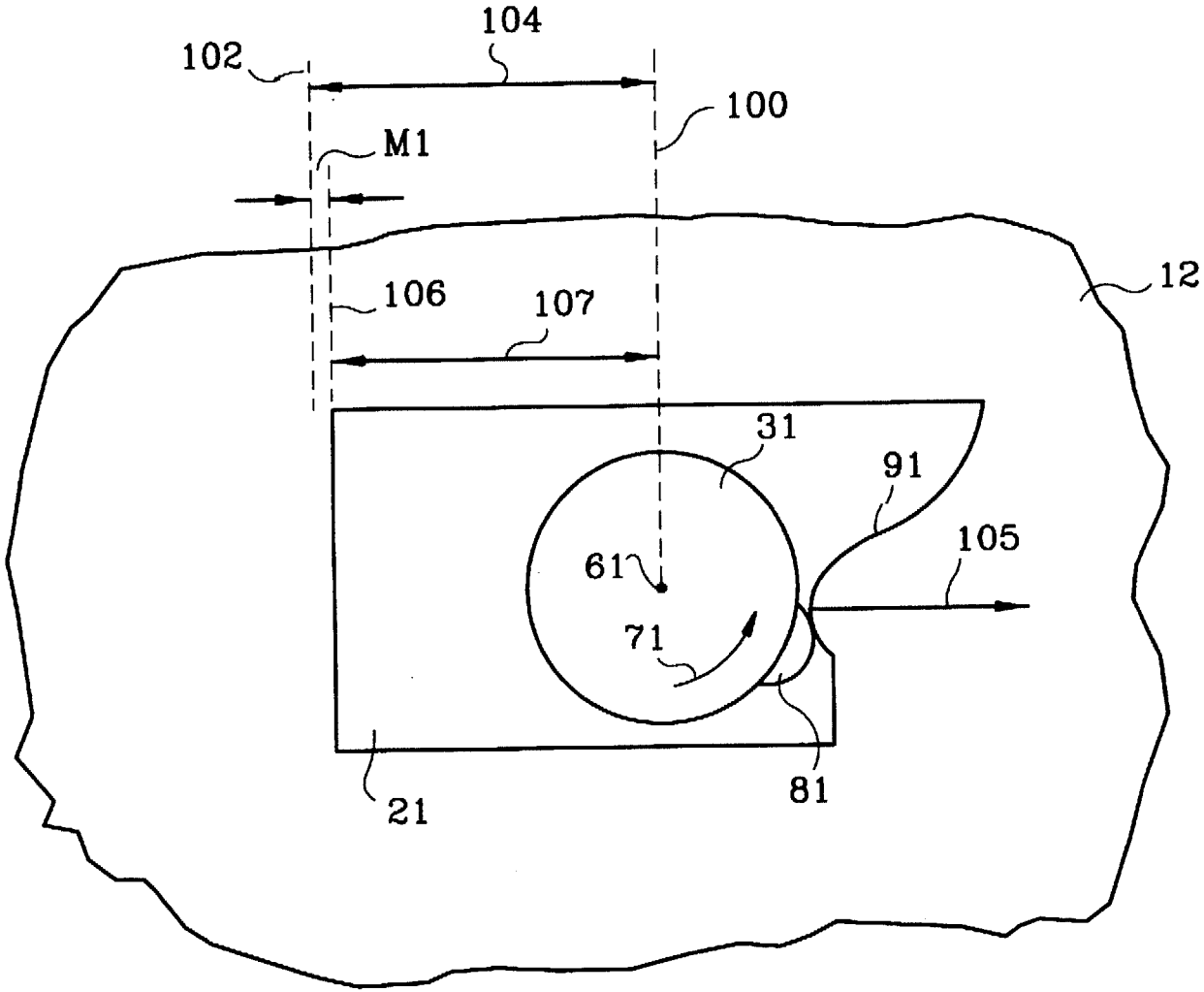
FIG. 5 shows the device of FIG. 4 after rotation of the rotatable cam.

FIG. 5 shows the device illustrated in FIG. 4 after the rotatable cam 31 is rotated in the direction represented by arrow 71. This rotation causes the cam surface 81 to move against a portion of the cam follower edge 91 of opening 21. Since the central axis 61 about which the rotatable cam 31 rotates is fixed in position, as represented by dashed line 100, the rotation of the rotatable cam 31 causes the movable member 12 to move toward the right as represented by arrow 105. This movement is schematically illustrated by the movement of the left edge of opening 21 from line 102, as shown in FIG. 4, to line 106. The magnitude of this movement is represented as M1 in FIG. 5. As described above in conjunction with FIG. 3, it can be understood that the switch actuating protrusion 40 moves toward the right by the same magnitude M1.

Figure 6:
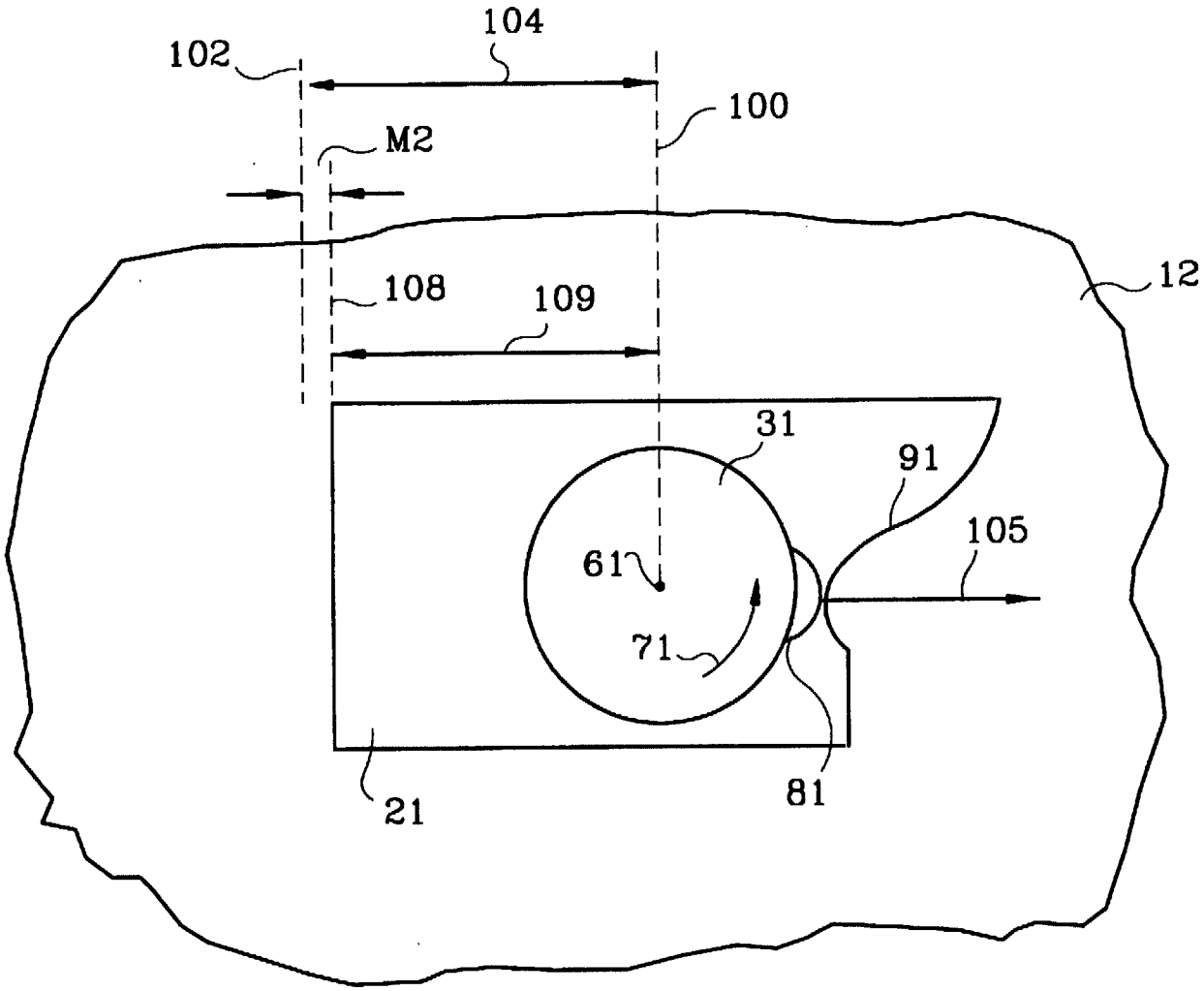
FIG. 6 shows the device of FIG. 5 after further rotation of the rotatable cam.

FIG. 6 represents the same opening 21 and rotatable cam 31 shown in FIGS. 4 and 5. In FIG. 6, the rotatable cam 31 has been rotated further in the direction represented by arrow 71 and the cam surface 81 has moved relative to the cam follower edge 91. This causes the movable member 12 to move farther to the right as represented by arrow 105. As represented by the difference between dashed lines 102 and 108, the movement of the movable member 12 has increased to that represented by dimension M2. Dashed line 102 represents the initial position of the left edge of opening 21 as shown in FIG. 4. In FIG. 6, the distance between the central axis 61 and the left edge of opening 21 is represented by arrow 109. The difference in magnitude between arrows 104 and 109 represent the change in position of the movable member 12 in response to rotation of the rotatable cam 31. As described above, the switch actuating protrusion attached to the movable member 12 is causes to move further toward the switch shown in FIG. 3 and is also caused to further depress the plunger 46. This depression of the plunger 46 actuated the switch 44.

Figure 7:
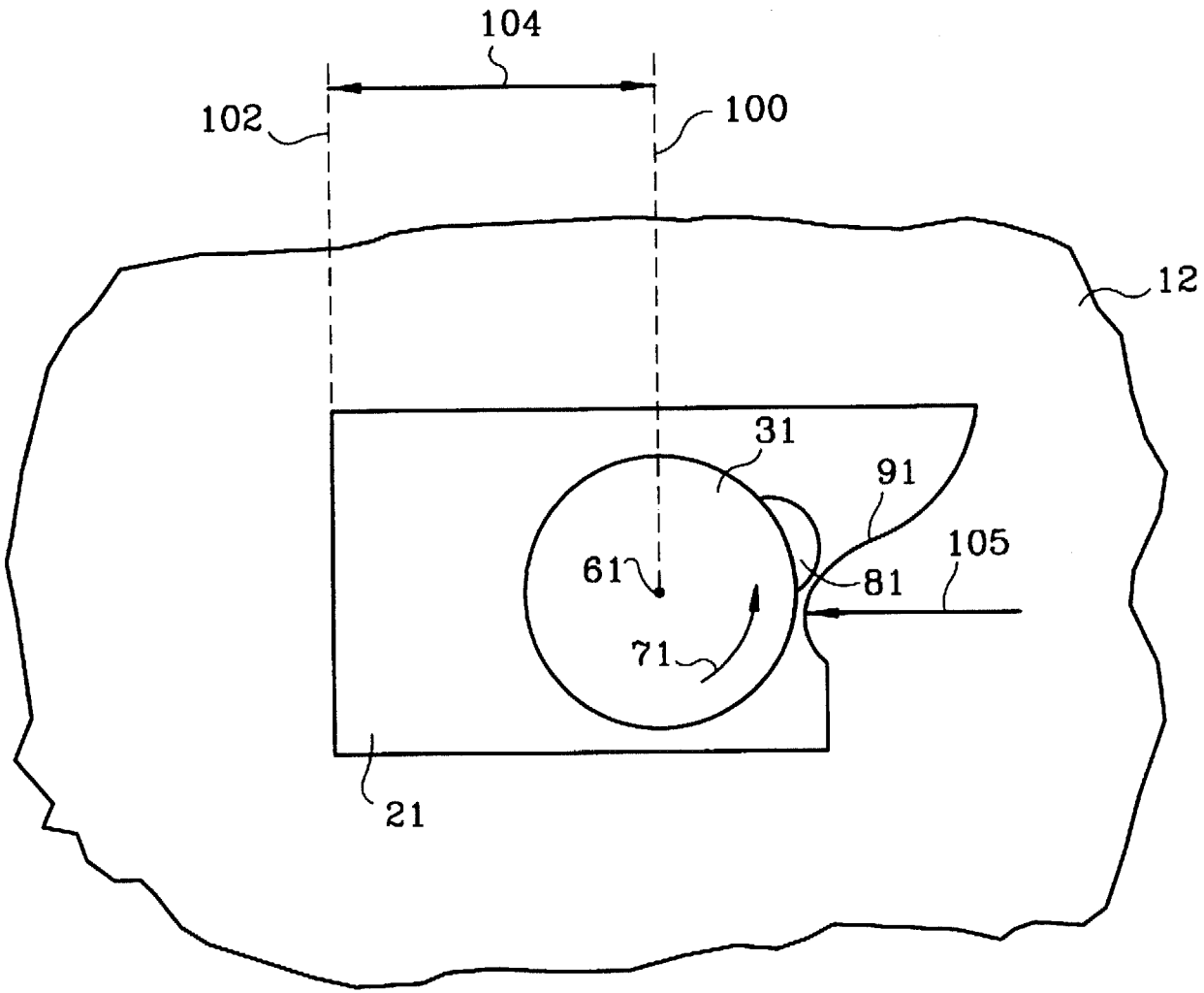
FIG. 7 shows the device of FIG. 6 after further rotation of the rotatable cam.

FIG. 7 shows the rotatable cam 31 after it has been further rotated in the direction represented by arrow 71. After the cam surface 81 has moved past the most extreme position of the cam follower edge 91, the force of the spring 54 causes the movable member 12 to move back toward the left as represented by arrow 105. It should be understood that, in a typical application of the present invention rotation of the rotatable cam 31 causes an increase in the flow of natural gas when the rotatable cam 31 is attached to a valve. However, the actuation of the switch by the switch actuating protrusion attached to the movable member 12 is momentary and occurs only when the movable member 12 is moved toward the right in response to contact between the cam surface 91 and the most extreme extension of the cam follower edge 91. The actuation of the switch can be used to activate an igniter in coordination with the introduction of the initial flow of natural gas by the valve in response to rotation of the rotatable cam 31. When applied to a kitchen range, for example, the rotatable cam 31 can be connected directly to a gas valve so that rotation of the rotatable cam 31 in response to rotation of a rotatable dial on the control panel of the range causes the flow of natural gas to be controlled.

Figure 8:
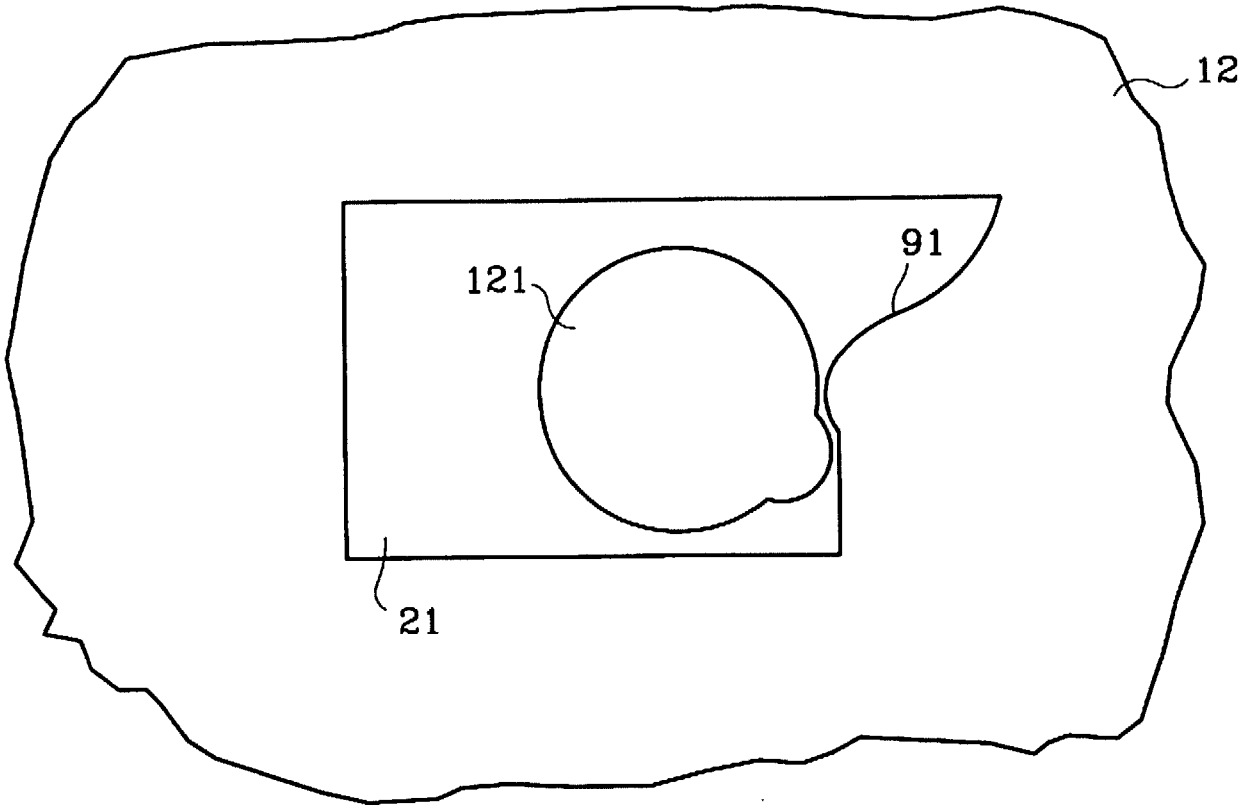
FIG. 8 shows an opening of the present invention associated with a hole formed through the thickness of a stationary member.

FIG. 8 illustrates the opening 21, as discussed above in conjunction with FIGS. 4–7, but without the presence of the rotatable cam 31. The purpose of FIG. 8 is to illustrate that a hole 121 is formed through the stationary member 10 to permit the introduction of the rotatable cam 31 into the opening 21 formed through the rotatable member 12. The shape of the hole 121 is selected to permit the rotatable cam and its cam surface 81 to pass through the thickness of the stationary member 10.

Figure 9:
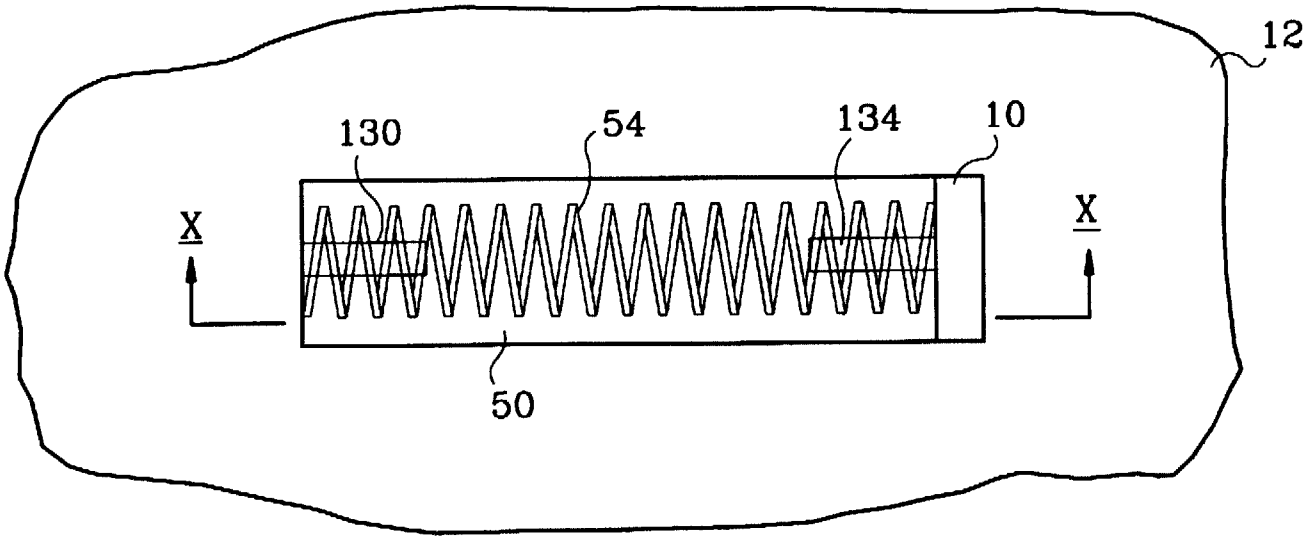
FIG. 9 is a partial view of the present invention illustrating a spring which is used to return the movable member to its rest position.

Although many mechanisms can be used in conjunction with the present invention to permit a spring to move the movable member 12 back to its rest position relative to the stationary member 10. FIG. 9 shows one possible configuration that performs this function. The space 50 extends through both the stationary and movable members. The spring 54 is disposed within the space 50 to exert a force against the stationary and movable members that return the movable member to its initial rest position relative to the stationary member. In order to facilitate the location of the spring 54, two protrusions are provided on the movable and stationary members to retain the spring in the space 50. A first protrusion 130 is attached to the movable member 12 and a second protrusion 134 is attached to the stationary member 10. These protrusions extend into the central opening of the spring 54 and retain it in position within the space 50. For purposes of illustration, the movable member 12 is shown moved slightly toward the right relative to the stationary member 10. This movement exposes a portion of the stationary member 10 to which the protrusion 134 is attached.

Figure 10:
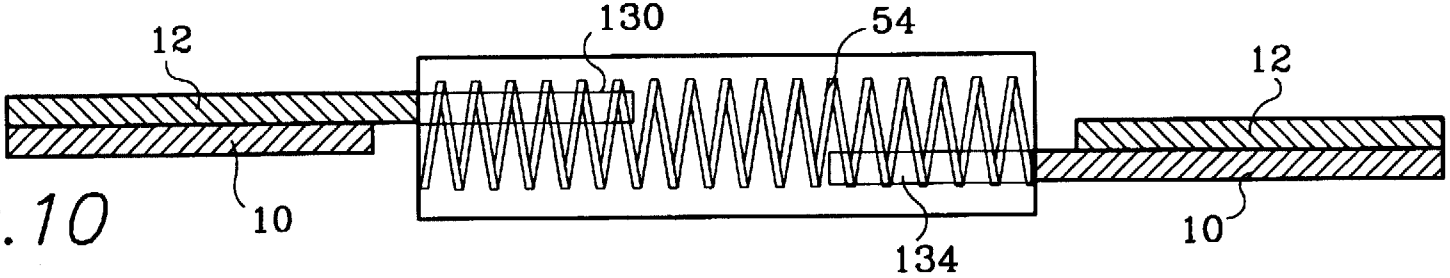
FIG. 10 is section view of the device shown in FIG. 9.

FIG. 10 is a section view of FIG. 9. In FIG. 10, the spring 54 is shown being retained by the protrusions, 130 and 134 which are attached to the movable member 12 and the stationary member 10, respectively. It should be clearly understood that many other types of spring retention mechanisms can be used in conjunction with the present invention. The primary function of the spring is to cause the movable member 12 to move back to its rest position when none of the rotatable cams is rotated about its respective central axis.

Figure 11:
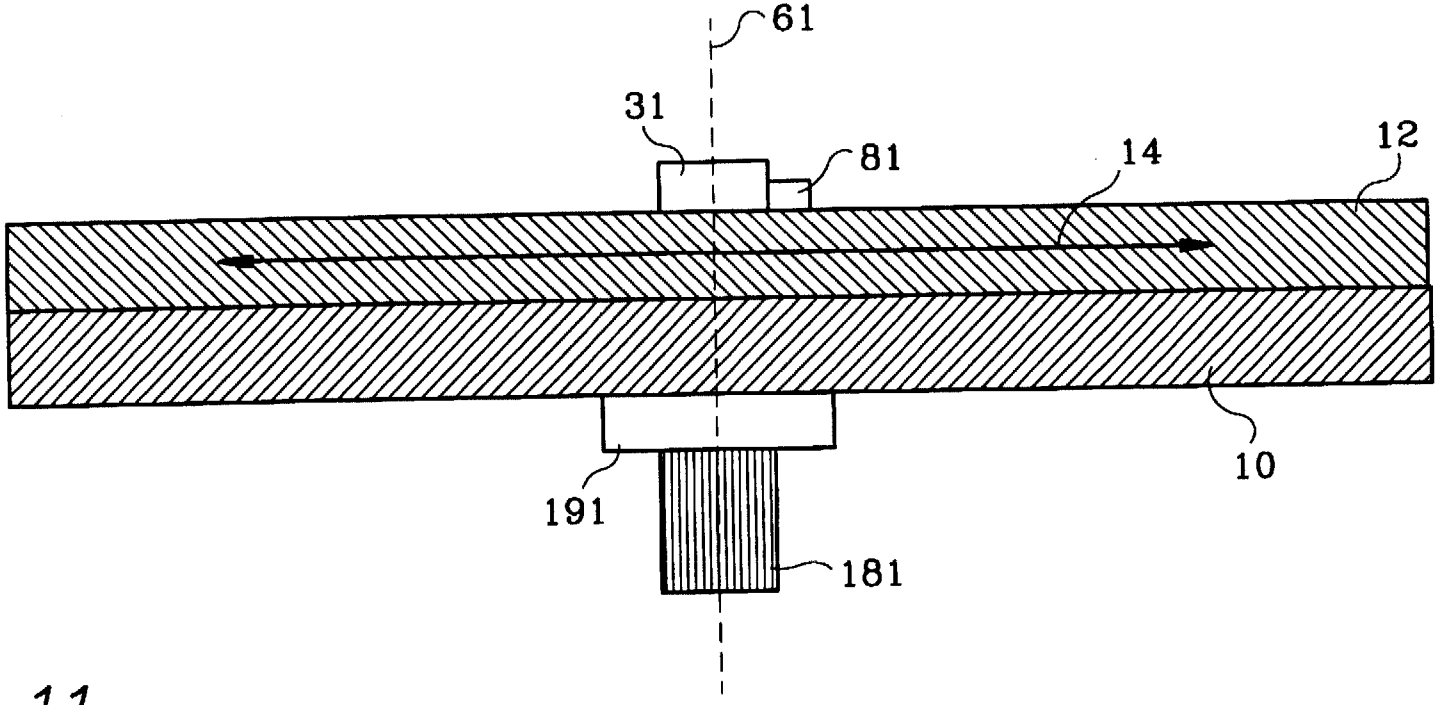
FIG. 11 is a sectional view showing the stationary and movable members of the present invention in association with a dial and its attached rotatable cam.

FIG. 11 is a sectional view showing the stationary member 10 and the movable member 12 with the rotatable cam 31 extending through the opening of the movable member 12. The central axis 61 of the rotatable cam 31 is also illustrated in FIG. 11. Attached to the rotatable cam 31 is a dial 181 and an indicator portion 191 which is attached to the dial 181. In operation, a person can rotate the dial 181 by hand and cause the rotatable cam 31 to move about its central axis 61 in the manner described above. This rotation of the rotatable cam 31 about its central axis 61 causes the cam surface 81 to move against the cam follower edge of the associated opening through the movable member 12 and cause it to move as represented by arrow 14 and described above.

Figure 12:
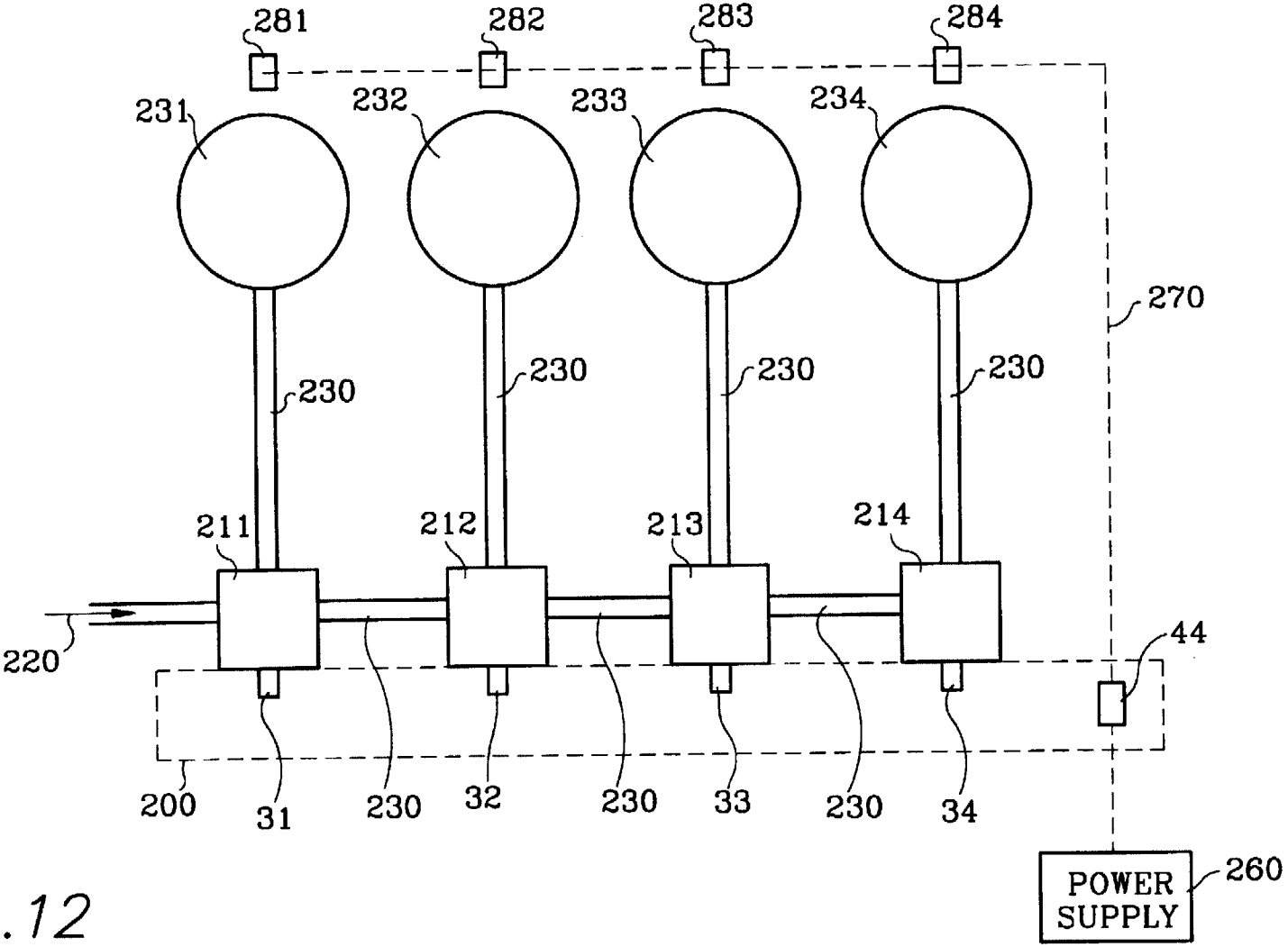
FIG. 12 is a schematic representation of the natural gas providing network of pipes, a plurality of burners, a plurality of valves and a plurality of igniters associated with the rotatable cams and switch of the present invention.

FIG. 12 is a schematic representation of the manner in which the present invention can be used in conjunction with a plurality of valves, burners and one or move igniters. Although FIG. 12 will be described in terms of a plurality of igniters, it should be understood that the physical configuration of the burners can be advantageously chosen to permit a single igniter to be used. Throughout this description, it should be therefore understood that the number of igniters used in conjunction with the present invention is not limiting to its scope. The use of a plurality of igniters in FIG. 12 and the following discussion is for purposes of simplicity of the description.

In FIG. 12, the rotatable cams are shown schematically and identified by reference numerals 31–34. Dashed box 200 represents the structure of the present invention described above. Switch 44 is shown as a part of that structure 200. In the configuration shown in FIG. 12, the plurality of rotatable cams, 31–34, are associated with a plurality of gas valves, 211–214. A supply of gas, represented by arrow 220 is provided through a series of pipes 230 through the individual gas valves, 211–214, to a plurality of burners, 231–234. When any one of the rotatable cams, 31–34, is rotated about its central axis, the associated gas valve causes the gas to flow through the associated pipe 230 to its associated burner. In other words, rotatable cam 31 causes gas valve 211 to permit gas to flow to burner 231.

With continued reference to FIG. 12, if any one of the rotatable cams, 31–34, is rotated about its central axis, switch 44 is actuated and an electrical current is permitted to pass from a power supply 260, such as a conventional wall receptacle, to the igniters. The current passes through an electrical line represented by dashed line 270 to the igniters, 281–284. As discussed above, a single igniter can be used to ignite the natural gas flowing through any one of the burners, 231–234, in alternative embodiments of the present invention. The number of igniters required depends on the physical location and configuration of the pipes 230 and the burners, 231–234. In FIG. 12, four igniters, 281–284, are illustrated for purposes of this description. In operation, rotation of any one of the rotatable cams, 31–34, will permit gas to flow through its associated gas valve, 211–214, and also move the movable member 12 into actuating relation with the plunger of the switch 44. This permits a current to flow to the associated igniter, 281–284, and ignite the gas flowing to the associated burner, 231–234. Throughout the Description of the Preferred Embodiment of the present invention, the ignition system is referred to as a plurality of igniters. This terminology shall be used to describe either a plurality of igniters or a single igniter that has the capability of igniting the gas flowing through any one of a plurality of burners.

Figure 13:
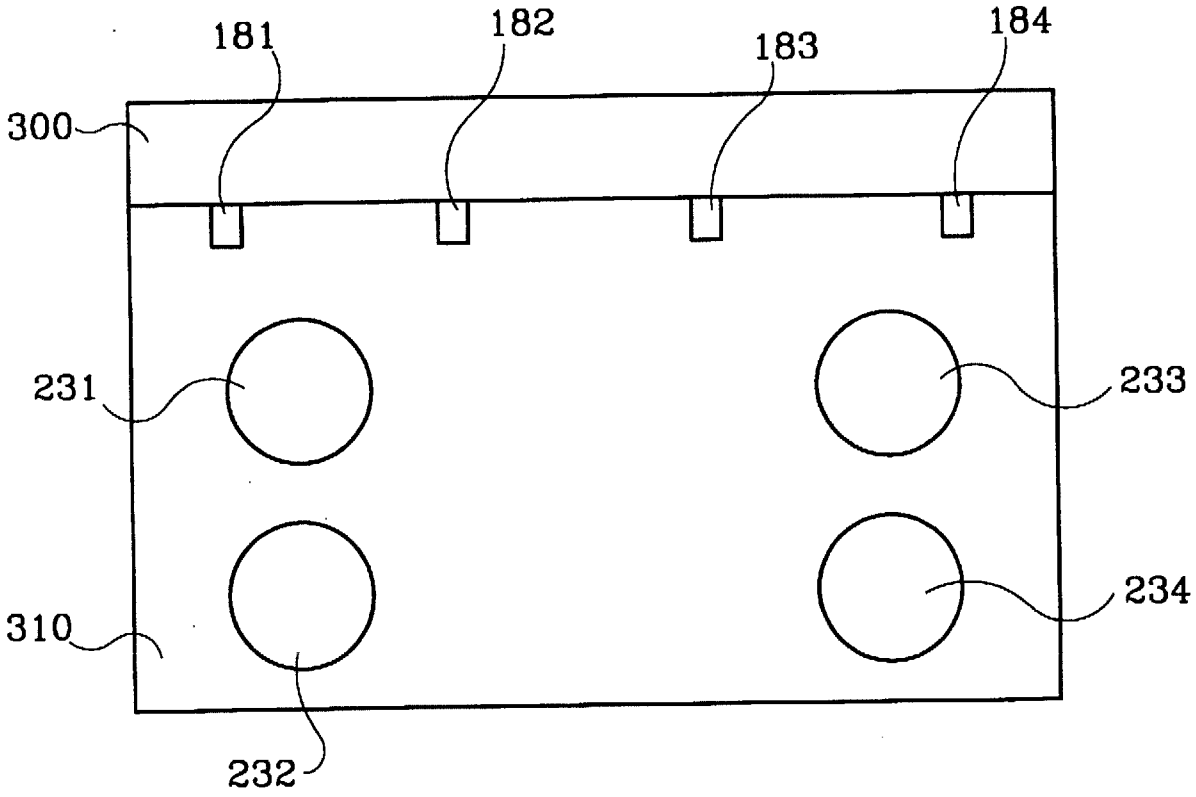
FIG. 13 is a top view of a conventional kitchen range.

FIG. 13 is a top view of a typical kitchen range that comprises four burners, 231–234. Four control dials, 181–184, are illustrated extending from the control panel 300 of the kitchen range 310. In operation, rotation of any one of the dials, 181–184, will cause gas to flow to its associated burner, 231–234, and will also cause the movable member 12 of the present invention to move relative to the stationary member 10. This movement will cause the switch actuating protrusion to push against the plunger of a switch and provide electrical current to a plurality of igniters. As discussed above, certain arrangements of the plurality of igniters will comprise a single igniter that is positioned at a location that enables it to ignite the natural gas flowing from any one of the plurality of burners.

The advantage of the present invention is that it requires only one switch even though the switch can be actuated by any one of a plurality of rotatable cams that rotate in response to rotation of an associated dial on the control panel of a device such as a kitchen range. Although the present invention has been described in considerable detail and illustrated with particular specificity, it should be understood that alternative embodiments of the present invention are also within its scope. For example, although the present invention has been described in terms of four rotating cams associated with four openings in the movable member and four holes in the stationary member, alternative numbers of rotatable cams are possible within the scope of the present invention. Furthermore, although four gas vales and four burners have been used to described the present invention, alternative numbers are possible. Most importantly, although the present invention has been described in terms of four igniters, it should be understood that the function performed by the plurality of igniters does not require more than one igniter in all instances. Therefore, the terminology that refers to a plurality of igniters should be understood to also include a single igniter that is positioned to perform the function of igniting the natural gas flowing from any one of a plurality of burners.

The embodiments of the invention in which an exclusive property or right is claimed are defined as follows:

1. A switch actuator, comprising:

a stationary member;

a movable member, said stationary and movable members being attached together in slideable relation with each other;

a plurality of openings formed through said movable member, each of said plurality of openings having an edge shaped to serve as a cam follower;

a plurality of holes formed through said stationary member, each of said plurality of holes being aligned with an associated one of said plurality of openings;

a plurality of rotatable cams, each of said rotatable cams being disposed within an associated one of said openings and disposed proximate said edge of said associated opening, each of said rotatable cams being rotatable about an associated one of a plurality of central axes, each one of said plurality of central axes extending through an associated one of said plurality of holes, whereby rotation of any one of said plurality of rotatable cams will cause said associated edge to move relative to said central axis of said associated rotatable cam and cause said movable member to move relative to said stationary member;

a switch actuating protrusion attached to said movable member; and a switch attached to said stationary member, said switch comprising a plunger, whereby said movement of said member relative to said stationary member in a preselected direction moves said switch actuating protrusion against said plunger and actuates said switch; and wherein:

actuation of said with initial actuation of a selected gas valve of said plurality of gas valves for an initial flow of gas; and further actuation of the selected gas valve of said plurality of gas valves, results in further rotation of a respective one of said plurality of rotatable cams to cause said associated edge and movable member to move back to an original position relative to said central axis and said stationary member respectively, and to deactuate said switch.

2. The actuator of claim 1, further comprising:

a plurality of burners, each of said plurality of burners being connected in gas receiving relation with an associated one of said plurality of gas valves.

3. The actuator of claim 2, further comprising:

a plurality of igniters, each of said plurality of igniters being disposed in gas igniting relation with an associated one of said plurality of burners.

4. The actuator of claim 3, wherein:

each of said plurality of igniters is electrically connected to said switch.

5. The actuator of claim 4 wherein upon further actuation of the selected gas valve of said plurality of gas valves, results in an increase in a flow of gas and deactivation of said plurality of ignitors.

6. The actuator of claim 5, wherein:

said plurality of burners are attached to a kitchen range.

7. A switch actuator, comprising:

a stationary member;

a movable member, said stationary and movable members being attached together in slideable relation with each other;

a plurality of openings formed through said movable member, each of said plurality of openings having an edge shaped to serve as a cam follower;

a plurality of holes formed through said stationary member, each of said plurality of holes being aligned with an associated one of said plurality of openings;

a plurality of rotatable cams, each of said rotatable cams being disposed within an associated one of said openings and disposed proximate said edge of said associated opening, each of said rotatable cams being rotatable about an associated one of a plurality of central axes, each one of said plurality of central axes extending through an associated one of said plurality of holes, whereby rotation of any one of said plurality of rotatable cams will cause said associated edge to move relative to said central axis of said associated rotatable cam and cause said movable member to move relative to said stationary member;

a switch actuating protrusion attached to said movable member;

a switch attached to said stationary member, said switch comprising a plunger, whereby said movement of said movable member relative to said stationary member in a preselected direction moves said switch actuating protrusion against said plunger and actuates said switch; and a plurality of gas valves, each of said gas valves being connected to an associated one of said plurality of rotatable cams and being actuatable in response to rotation of said associated one of said plurality of said rotatable cams; and wherein:

actuation of said switch is in coordination with initial actuation of a selected gas valve of said plurality of gas valves, for an initial flow of gas; and further actuation of the selected gas valve of said plurality of gas valves, results in further rotation of a respective one of said rotatable cams to cause said associated edge and movable member to move back to an original position relative to said central axis and said stationary member, respectively.

8. The actuator of claim 7, further comprising:

a plurality of burners, each of said plurality of burners being connected in gas receiving relation with an associated one of said plurality of gas valves.

9. The actuator of claim 8, further comprising:

a plurality of igniters, each of said plurality of igniters being disposed in gas igniting relation with an associated one of said plurality of burners.

10. The actuator of claim 9, wherein:

each of said plurality of igniters is electrically connected to said switch.

11. The actuator of claim 10 wherein upon further actuation of the selected gas valve of said plurality of gas valves results in an increase in a flow of gas and deactivation of said plurality of ignitors.

12. The actuator of claim 11, wherein:

said plurality of burners are attached to a kitchen range.

13. A switch actuator, comprising:

stationary member;

a movable member, said stationary and movable members being attached together in slideable relation with each other;

a plurality of openings formed through said movable member, each of said plurality of openings having an edge shaped to serve as a cam follower;

a plurality of holes formed through said stationary member, each of said plurality of holes being aligned with an associated one of said plurality of openings;

a plurality of rotatable cams, each of said rotatable cams being disposed within an associated one of said openings and disposed proximate said edge of said associated opening, each of said rotatable cams being rotatable about an associated one of a plurality of central axes, each one of said plurality of central axes extending through an associated one of said plurality of holes, whereby rotation of any one of said plurality of rotatable cams will cause said associated edge to move relative to said central axis of said associated rotatable cam and cause said movable member to move relative to said stationary member;

a switch actuating protrusion attached to said movable member;

a switch attached to said stationary member, said switch comprising a plunger, whereby said movement of said movable member relative to said stationary member in a preselected direction moves said switch actuating protrusion against said plunger and actuates said switch;

a plurality of gas valves, each of said gas valves being connected to an associated one of said plurality of rotatable cams and being actuatable in response to rotation of said associated one of said plurality of said rotatable cams;

a plurality of burners, each of said plurality of burners being connected in gas receiving relation with an associated one of said plurality of gas valves; and wherein:

actuation of said switch is in coordination with initial actuation of a selected gas valve of said plurality of gas valves, for an initial flow of gas;

further actuation of the selected gas valve of said plurality of gas valves, results in further rotation of a respective one of said rotatable cams to cause said associated edge and movable member to move back to an original position relative to said central axis and said stationary member, respectively; and further actuation of the selected gas valve of said plurality of gas valves results in an increase in a flow of gas and deactivation of said plurality of igniters.

14. The actuator of claim 13, further comprising:

a plurality of igniters, each of said plurality of igniters being disposed in gas igniting relation with an associated one of said plurality of burners.

15. The actuator of claim 14, wherein:

each of said plurality of igniters is electrically connected to said switch.

16. The actuator of claim 15, wherein:

said plurality of burners are attached to a kitchen range.

* * * * *